US005551244A

United States Patent [19]

Bailey

[11] Patent Number: 5,551,244

[45] Date of Patent: Sep. 3, 1996

[54] HYBRID THERMOELECTRIC/JOULE-THOMSON CRYOSTAT FOR COOLING DETECTORS

[75] Inventor: Theodore B. Bailey, Chelmsford, Mass.

[73] Assignee: Martin Marietta Corporation, Bethesda, Md.

[21] Appl. No.: 344,602

[22] Filed: Nov. 18, 1994

[51] Int. Cl.[6] ..... F25B 19/02; F25B 21/02

[52] U.S. Cl. ..... 62/51.2; 62/6; 62/3.2; 62/3.6

[58] Field of Search ..... 62/6, 3.2, 3.6, 62/51.2

[56] References Cited

U.S. PATENT DOCUMENTS

| | | | |
|---|---|---|---|
| 4,697,425 | 10/1987 | Jones | 62/51.2 X |
| 4,750,338 | 6/1988 | Hingst | 62/51.2 |
| 4,766,741 | 8/1988 | Bartlett et al. | 62/51.1 |
| 4,819,451 | 4/1989 | Hingst | 62/51.2 |
| 4,825,667 | 5/1989 | Benedict et al. | 62/51.2 |
| 4,831,829 | 5/1989 | Jones et al. | 62/22 |
| 4,951,471 | 8/1990 | Sakitani et al. | 62/51.2 |
| 4,993,230 | 2/1991 | Hingst | 62/51.2 |
| 5,006,505 | 4/1991 | Skertic | 505/1 |
| 5,150,579 | 9/1992 | Hingst | 62/51.2 |
| 5,339,649 | 8/1994 | Kawai et al. | 62/46.1 |

FOREIGN PATENT DOCUMENTS

| | | |
|---|---|---|
| 404335959 | 11/1992 | Japan . |
| 404350484 | 12/1992 | Japan . |
| 2241565 | 9/1991 | United Kingdom . |

*Primary Examiner*—Christopher Kilner
*Attorney, Agent, or Firm*—Burns, Doane, Swecker & Mathis, L.L.P.

[57] ABSTRACT

A hybrid thermoelectric/Joule-Thomson cryostat with a finite cryogenic gas supply is configured to greatly increase the cold operating time of a infrared detector array. A Joule-Thomson cryostat is located within a dewar vessel along with the infrared detector array to be cooled. Cryogenic gas from a cryogenic gas source is pre-cooled by a thermoelectric cooler at a location remote from the dewar vessel. Final cooling of the cryogenic gas is then performed by a demand flow Joule-Thomson cooler which has the ability to provide the low temperatures necessary for operation of an infrared detector. The operating period of the cryogenic gas supply and Joule-Thomson cryostat are increased by the cryogenic assistance of the thermoelectric cooler.

28 Claims, 2 Drawing Sheets

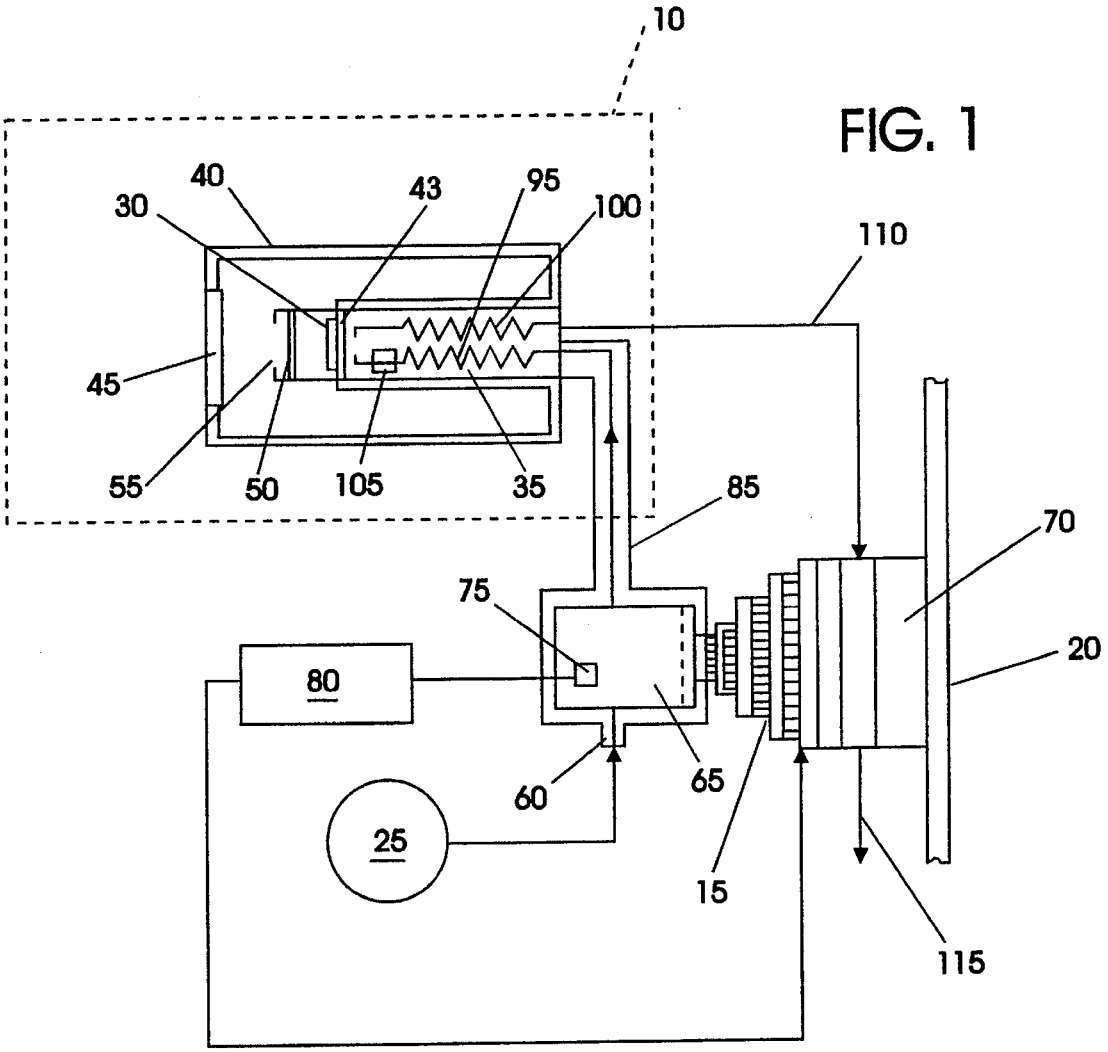
FIG. 1
FIG. 2
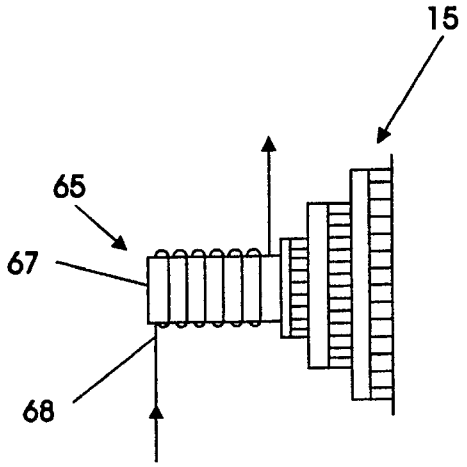

HYBRID THERMOELECTRIC/JOULE-THOMSON CRYOSTAT FOR COOLING DETECTORS

BACKGROUND OF THE INVENTION

1. Field of the Invention

The invention relates to a cryogenic cooler for cooling an infrared detector employing a thermoelectric cooler and a Joule-Thomson cryostat.

2. Background and Summary of the Invention

Generally, infrared detectors must be cooled to extremely low temperatures to increase their sensitivity. Cryogenic coolers based on the Joule-Thomson effect have been used to cool detectors, however, when a limited cryogenic gas supply is available, for example in a gas reservoir in a missile or in a portable apparatus, the operating time of the cooler is limited by the available gas supply. Attempts to provide extended cooler operating times using thermoelectric (TE) coolers have been unsuccessful because TE coolers are unable to achieve the low temperatures necessary for operation of the detectors.

Other types of coolers have also been used to extend the operating time of infrared detectors including closed cycle coolers and internal gas compressors. These have resulted in coolers which are too expensive for most applications and are not able to cool to the low temperatures necessary for most detectors.

It has been suggested to combine a TE cooler and a Joule-Thomson (JT) cryostat by mounting a TE cooler at the base of a JT cryostat to regulate the temperature of incoming gas. In such an arrangement, when the TE cooler is mounted at the base of the JT cryostat, both the TE cooler and the JT cryostat are located within a dewar vessel. The dewar vessel including the TE cooler is mounted on a gimbal to permit the detector array to be aimed at a heat source. Mounting the TE cooler in the dewar vessel, however, limits the size and capacity of the TE cooler. TE coolers generate a significant amount of heat during operation and require means for disposing the heat, for example, a heat sink for efficient operation. The lack of a good heat sink when the TE cooler is mounted on a gimbal assembly limits the cooling capacity of the TE cooler and prevents any significant increase of the operating period for the system.

Another cryogenic cooling system employs two-stage JT coolers in which one cooling fluid is used in a first JT cooler for pre-cooling a second cooling fluid. The second cooling fluid is in turn used in a second JT cooler to cool a detector. This system requires two cooling gas supplies, and is accordingly more complex and expensive. This type of cooling system also has the disadvantage known in single stage cryogenic coolers of having limited gas supplies, and correspondingly limited operating periods.

A cooling system according to the present invention increases the operating period of a conventional Joule-Thomson cryostat cooler having a limited supply of cryogenic gas by adding a thermoelectric cooler to pre-cool the cryogenic gas. The present invention provides a TE cooler having a significant cooling capacity by locating the TE cooler on a heat sink remote from the JT cryostat. The TE cooler increases the cooling capacity of the cryogenic gas so that the cryogenic gas is conserved.

According to the present invention a cryogenic cooling apparatus is provided having a source of gas under pressure, a thermoelectric cooler for pre-cooling the pressurized gas, a dewar vessel, and a Joule-Thompson cooler within the dewar vessel. The TE cooler for pre-cooling the gas is in fluid communication with the source of pressurized gas. The JT cryostat is located within the dewar vessel and receives pressurized gas which has been precooled by the TE cooler at a location remote from the dewar vessel. The JT cryostat then employs the Joule-Thomson effect to cool a detector within the dewar vessel by expanding the pre-cooled pressurized gas. The JT cryostat operates more efficiently with the lowered inlet gas temperature and can extend the operating period of the JT cryostat when operating with a limited gas supply. The gas exiting the JT cryostat which is still cool is vented to a hot side of the TE cooler to aid in reducing the temperature of the TE cooler.

In accordance with another aspect of the invention, a missile seeker assembly includes a missile shell, a source of pressurized gas within the missile shell, a TE cooler and a dewar vessel within the missile shell. The TE cooler is in fluid communication with the source of pressurized gas to pre-cool the pressurized gas, The dewar vessel includes an infrared detector array and a JT cryostat for cooling the array. The JT cryostat receives the pre-cooled pressurized gas from the TE cooler and expands the pre-cooled gas to cool the detector,

BRIEF DESCRIPTION OF THE DRAWINGS

FIG. 1 is a schematic view of the hybrid cryostat according to the present invention;

FIG. 2 is a schematic view of a high pressure heat exchanger for the hybrid cryostat of FIG. 1;

DETAILED DESCRIPTION OF PREFERRED EMBODIMENTS

Figure 3:
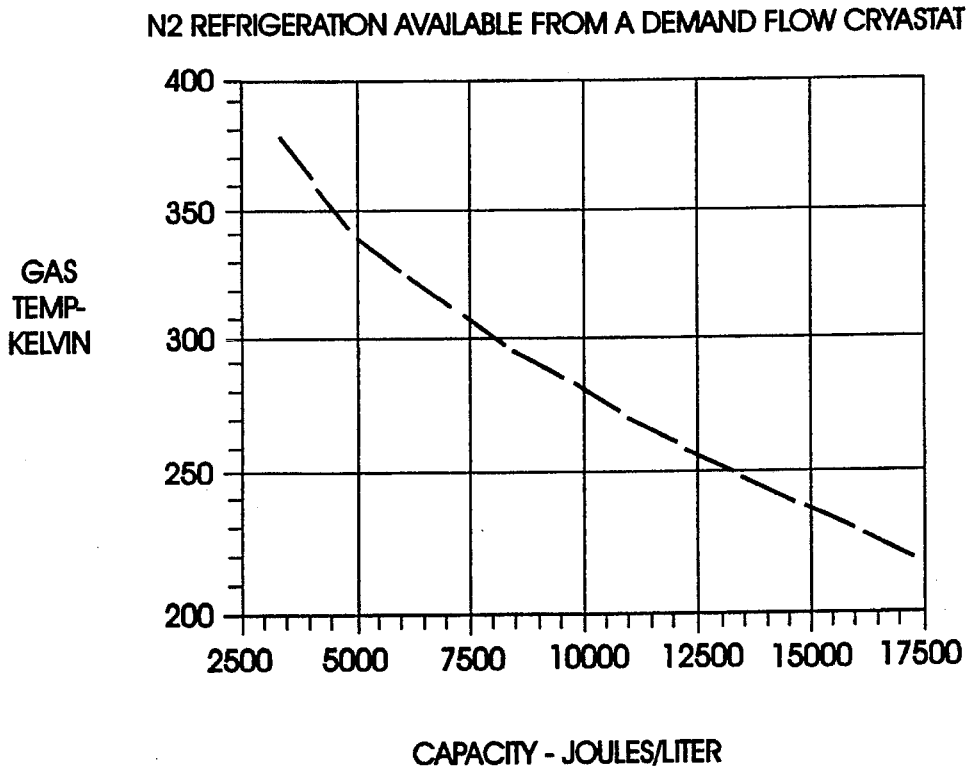
FIG. 3 is a graph of the refrigeration available from a demand flow cryostat; and, FIG. 4 is a schematic view of the hybrid cryostat mounted in a missile shell.

As depicted in FIG. 1, the cooling apparatus according to a preferred embodiment generally includes a detector dewar assembly 10, a TE cooler 15 located remote from the dewar assembly on a heat sink 20, and a cryogenic gas source 25. The detector dewar assembly 10 includes an infrared detector array 30 and a JT cryostat 35 for cooling the detector. The detector array 30 is mounted within a dewar vessel 40 on a cold plate 43 which supports the detector array and transmits the cooling effect from the JT cryostat 35 evenly to the detector array. The detector array 30 is exposed to infrared radiation through a window 45 provided on a front surface of the dewar vessel 40. A cold filter 50 and a cold shield 55 are provided between the detector array 30 and the window 45 for helping to maintain the temperature of the detector array and for filtering and directing the infrared radiation to the detector array.

The TE cooler 15 is located remote from the JT-cryostat 35 so that heat generated by the TE cooler will not reduce the cooling capacity of the JT-cryostat. The TE cooler includes a cold side 65 for cooling the pressurized gas and a hot side 70 for dissipating heat generated by the cooling of the gas. The hot side 70 is preferably mounted on a heat sink 20 with a large surface area exposed to ambient air. When the detector array 30 and the cooling apparatus are mounted in a missile, the skin of the missile advantageously provides an appropriate heat sink.

The operation of the cooling apparatus is described as follows. Cryogenic gas is provided from the cryogenic gas source 25, such as a tank or reservoir, at a temperature T1 to an inlet 60 at the cold side 65 of the TE cooler 15. The TE cooler 15 operates by sending an electric current through a plurality of thermocouples of semiconducting materials arranged in series. The current passing through the thermocouples creates a temperature differential between consecutive thermocouple junctions. The temperature differential between the junctions creates the cold side 65 and the hot side 70 of the TE cooler 15. The cold side 65 of the TE cooler 15 may include a high pressure, high efficiency heat exchanger to provide good heat exchange between the TE cooler and the gas. As illustrated in FIG. 2, the heat exchanger may comprise a stud 67 of thermally conductive material, for example, copper, mounted in thermal contact with the cold side 65 of the TE cooler 15 and a gas conduit 68 coiled around the stud. The cryogenic gas flowing through the inlet 60 of the cold side 65 of the TE cooler 15 is cooled by passing through the cold side heat exchanger. A temperature sensor 75 measures the temperature of the cold side 65. Temperature information provided by the temperature sensor 75 is transmitted to a temperature control unit 80 which controls the operation of the TE cooler 15 so that the gas is cooled to a desired temperature T2. According to a presently preferred embodiment, the TE cooler is capable of reducing the temperature of the pressurized gas by at least 150K.

The pre-cooled gas then exits the TE cooler 15 at the temperature T2 through a gas line 85. The gas line 85 may be formed as a flexible line so that it can connect the TE cooler 15, which is stationary, with the dewar vessel 40, which may be positioned on a pivotable gimbal platform 90 (shown in FIG. 4) for purposes of aiming the detector array 30 at a source of infrared radiation. According to a preferred embodiment of the invention, the gas line 85 and the cold side 65 of the TE cooler 15 are insulated to prevent warming of the pre-cooled pressurized gas.

The pre-cooled gas from the TE cooler 15 enters the forward flow heat exchanger conduit 95 of the JT cryostat 35 where it is cooled by expanded gas returning from the cold plate 43 in the return flow heat exchanger conduit 100. A demand flow JT cooler 105 meters the gas flow from the forward flow conduit 95 through an expansion nozzle (not shown) to only that amount of gas necessary to maintain the operating temperature required by the detector array 30. The temperature of the detector array 30 may be measured by a temperature sensor (not shown) located either on the detector array or on the cold plate 43. The use of a demand flow expansion nozzle increases the efficiency of the cooling system and conserves a limited supply of cryogenic gas.

Exhaust gas from the JT cryostat 35 exits the JT cryostat through an exhaust gas line 110 at a temperature T3 which is slightly below the inlet gas temperature T2 due to some losses in the JT cryostat. This cold gas is vented to the hot side 70 of the TE cooler 15 and exits as exhaust gas at exit 115. The hot side 70 of the TE cooler 15 is constructed with fins of a thermally conductive material to increase the surface area exposed to the gas and improve the efficiency of the heat exchanger. The exhaust gas at temperature T3 passes around the fins and cools the fins. The exhaust gas reduces the temperature of the TE cooler 15 which increases the efficiency of the system, and therefore increases the cooling capacity of a limited cryogenic gas supply. In a preferred embodiment the TE cooler 15 is mounted on a heat sink 20 with a large amount of surface area exposed to ambient air, such as the skin of a missile, in order to dissipate accumulated heat.

The amount of refrigeration available from a given volume of gas is determined by the temperature, pressure and type of the gas. FIG. 3 shows the stored refrigeration capacity available to an 85% efficient JT cryostat at different gas inlet temperatures. As can be seen on the graph, lowering the inlet temperature by the TE cooler provides an increase in the refrigeration capacity of a given volume of cryogenic gas. For example, if the temperature of the gas entering the JT cryostat is reduced by 150K from 375K to 225K by the TE cooler, then the capacity provided by a set quantity of gas is increased more than 4.5 times from 3500 to 16,500 Joules/liter. According to a presently preferred embodiment, the TE cooler 15 has the capacity to lower the temperature of the pressurized gas at least 150K.

Figure 4:
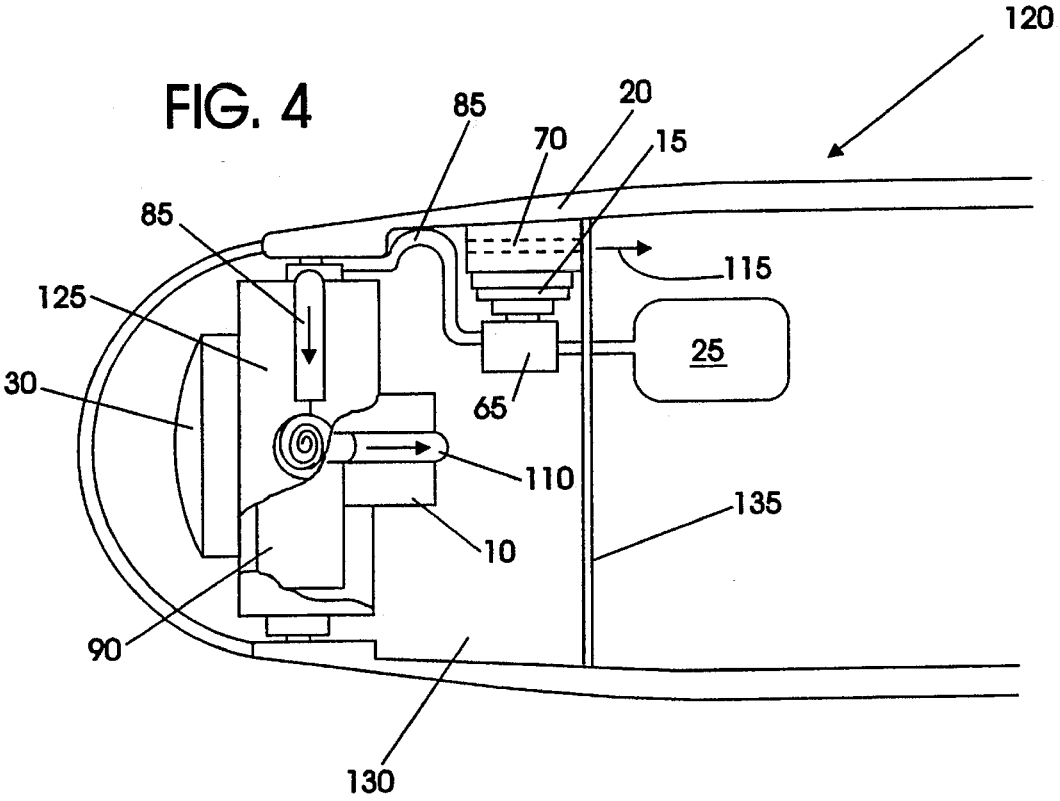

FIG. 4 is a schematic view of a preferred embodiment of the hybrid cryostat mounted in a missile shell 120. The detector dewar assembly 10 is mounted on the gimbal platform 90 so that the detector array 30 within the dewar assembly may be aimed at a source of infrared radiation. The gimbal platform 90 is supported by a gimbal ring 125 which allows the platform to be pivoted in two perpendicular directions. The gimbal platform 90 is mounted within a sealed cavity 130 located in a front portion of the missile head. The sealed cavity 130 is separated from the remainder of the missile by the bulkhead 135. The hot side 70 of the TE cooler 15 is mounted on an interior surface of the missile skin 20, which provides a large heat sink for dissipating unwanted heat.

In operation, pressurized gas enters the TE cooler 15 from the pressurized gas source 25 through the bulkhead 135 and is cooled in the TE cooler as described above. The pre-cooled pressurized gas then passes through the gas line 85 to the JT cryostat (not shown) and is used to cool the detector array. Exhaust gas from the JT cryostat is released from exhaust gas line 110 into the sealed cavity 130. The gas then exits the sealed cavity 130 through the hot side 70 of the TE cooler 15 where it is used to assist in cooling the TE cooler and improving the efficiency of the system.

While a preferred embodiment of the invention has been described in detail, it will be apparent to those skilled in the art that various changes and modifications can be made without departing from the spirit and scope of the claimed invention.

What is claimed is:

1. A low gas consumption cryogenic cooling apparatus comprising:

a container for pressurized gas;

a thermoelectric cooler in fluid communication with said container for pre-cooling said pressurized gas, said thermoelectric cooler including a cold side for precooling cooling the cryogenic gas and a hot side for dissipating heat;

a heat sink having a large surface area exposed to ambient air, the hot side of the thermoelectric cooler being mounted on the heat sink:

a dewar vessel; and a Joule-Thomson cryostat mounted within the dewar vessel and located remote from said thermoelectric cooler, said Joule-Thomson cryostat being in fluid communication with said thermoelectric cooler and receiving pre-cooled pressurized gas from said thermoelectric cooler.

2. The cryogenic cooling apparatus of claim 1, further comprising a temperature sensor located in the cold side of said thermoelectric cooler and a temperature control unit for controlling the thermoelectric cooler responsive to a temperature sensed by the temperature sensor.

3. The cryogenic cooling apparatus of claim 1, wherein said Joule-Thomson cryostat includes an exhaust gas outlet connected to the hot side of said thermoelectric cooler, so that said thermoelectric cooler receives exhaust gas from said Joule-Thomson cryostat exhaust gas outlet for reducing the temperature of said thermoelectric cooler.

4. The cryogenic cooling apparatus of claim 1, wherein said heat sink is the skin of a missile.

5. The cryogenic cooling apparatus of claim 1, wherein said container for pressurized gas has a finite capacity.

6. The cryogenic cooling apparatus of claim 1, further comprising a gimbaled platform, said Joule-Thomson cryostat and said dewar vessel being located on said gimbaled platform and wherein said heat sink is a non-gimbaled surface.

7. The cryogenic cooling apparatus of claim 6, wherein said non-gimbaled surface is the skin of a missile.

8. The cryogenic cooling apparatus of claim 6, further comprising a flexible gas line connecting said thermoelectric cooler and said Joule-Thomson cryostat.

9. The cryogenic cooling apparatus of claim 1, wherein the thermoelectric cooler is capable of reducing the temperature of the pressurized gas by at least 150K.

10. A low gas consumption cryogenic cooling apparatus comprising:

a container for pressurized gas;

a thermoelectric cooler in fluid communication with said container for pre-cooling said pressurized gas;

a heat sink surface exposed to ambient atmosphere, the thermoelectric cooler being mounted to the heat sink so that heat generated by the thermoelectric cooler is dissipated by said heat sink;

a dewar vessel; and a Joule-Thomson cryostat mounted within the dewar vessel and located remote from said thermoelectric cooler, said Joule-Thomson cryostat including an inlet in fluid communication with said thermoelectric cooler for receiving pre-cooled pressurized gas from said thermoelectric cooler, a reverse flow heat exchanger in fluid communication with said inlet for cooling said pressurized gas received through the inlet, a demand flow expansion nozzle in fluid communication with said heat exchanger for metering a cooling gas flow only to that necessary to maintain an interior portion of the dewar at a predetermined temperature, and an exhaust gas outlet connected to said heat exchanger to duct exhaust gas from the dewar vessel.

11. The cryogenic cooling apparatus of claim 10, wherein said thermoelectric cooler includes a cold side for pre-cooling the cryogenic gas and a hot side for dissipating heat, said hot side connected to said exhaust gas outlet to receive a flow of exhaust gas from said Joule-Thomson cryostat to cool said thermoelectric cooler.

12. The cryogenic cooling apparatus of claim 11, wherein said cold side of the thermoelectric cooler is insulated.

13. The cryogenic cooling apparatus of claim 11, further comprising means for controlling the thermoelectric cooler to cool the gas to a predetermined temperature.

14. The cryogenic cooling apparatus of claim 13, wherein said means for controlling the thermoelectric cooler comprises a temperature control unit responsive to a temperature sensor located in the cold side of said thermoelectric cooler.

15. The cryogenic cooling apparatus claim 10, further comprising an infrared detector array mounted within the dewar vessel, wherein the detector array is maintained at a predetermined temperature by the metering of gas by the demand flow expansion nozzle.

16. A missile seeker assembly comprising:

a missile shell:

a source of pressurized gas within the missile shell;

a thermoelectric cooler in fluid communication with said source of pressurized gas, mounted on an interior surface of a missile skin, said skin providing a heat sink for dissipating heat;

a dewar vessel mounted within the missile shell; an infrared detector array located within the dewar vessel; and a Joule-Thomson cryostat mounted within the dewar vessel and located remote from said thermoelectric cooler, said Joule-Thomson cryostat receiving pre-cooled pressurized gas from said thermoelectric cooler.

17. The cryogenic cooling apparatus of claim 16, wherein said thermoelectric cooler includes a cold side for pre-cooling the cryogenic gas and a hot side for dissipating heat.

18. The cryogenic cooling apparatus of claim 17, wherein said Joule-Thomson cryostat includes an exhaust gas outlet connected to the hot side of said thermoelectric cooler, so that said thermoelectric cooler receives exhaust gas from said Joule-Thomson cryostat exhaust gas outlet for reducing the temperature of said thermoelectric cooler.

19. The cryogenic cooling apparatus of claim 17, further comprising a temperature sensor located in the cold side of said thermoelectric cooler and a temperature control unit for controlling the thermoelectric cooler responsive to a temperature sensed by the temperature sensor.

20. The cryogenic cooling apparatus of claim 17, wherein said thermoelectric cooler is mounted on an interior surface of a missile skin, said skin providing a heat sink for dissipating accumulated heat.

21. The cryogenic cooling apparatus of claim 16, further comprising a gimbaled platform, said Joule-Thomson cryostat and said dewar vessel being located on said gimbaled platform and said thermoelectric cooler being mounted on a non-gimbaled surface.

22. The cryogenic cooling apparatus of claim 21, further comprising a flexible gas line connecting said thermoelectric cooler and said Joule-Thomson cryostat.

23. The cryogenic cooling apparatus of claim 16, wherein the thermoelectric cooler is capable of reducing the temperature of the pressurized gas by at least 150K.

24. A method of cooling an infrared detector array comprising the steps of:

providing a cryogenic gas source;

pre-cooling cryogenic gas from the cryogenic gas source to a predetermined temperature with a thermoelectric cooler, the thermoelectric cooler being mounted on a heat sink exposed to ambient air to dissipate heat from the thermoelectric cooler;

passing the pre-cooled gas through a Joule-Thomson cryostat which includes a demand flow expansion nozzle; and cooling the infrared detector by metering the cryogenic gas through the demand flow expansion nozzle to maintain an operating temperature.

25. The method of claim 24, further comprising a step of further cooling the pre-cooled gas in the Joule-Thomson cryostat with exhaust gas from the infrared detector array.

26. The method of claim 24, further comprising a step of directing exhaust gas from the Joule-Thomson cryostat through a hot side of the thermoelectric cooler to reduce the temperature of the thermoelectric cooler hot side.

27. The method of claim 26, further comprising the step of controlling the thermoelectric cooler with a temperature control unit in order to maintain the gas exiting the thermoelectric cooler at a predetermined temperature.

28. The method of claim 24, wherein the cryogenic gas is pre-cooled by about 150K by the thermoelectric cooler.

* * * * *

UNITED STATES PATENT AND TRADEMARK OFFICE

CERTIFICATE OF CORRECTION

PATENT NO. : 5,551,244

DATED : September 3, 1996

INVENTOR(S) : Theodore B. Bailey

It is certified that error appears in the above-indentified patent and that said Letters Patent is hereby corrected as shown below:

Column 4,
Claim 1, line 7 delete "cooling".

Signed and Sealed this
Twenty-eighth Day of January, 1997

*Attest:*

Bruce Lehman

BRUCE LEHMAN

*Attesting Officer*

*Commissioner of Patents and Trademarks*